United States Patent [19]

Marschman et al.

[11] Patent Number: 4,871,438

[45] Date of Patent: Oct. 3, 1989

[54] CERMET ANODE COMPOSITIONS WITH HIGH CONTENT ALLOY PHASE

[75] Inventors: Steven C. Marschman; Norman C. Davis, both of Richland, Wash.

[73] Assignee: Battelle Memorial Institute, Richland, Wash.

[21] Appl. No.: 116,474

[22] Filed: Nov. 3, 1987

[51] Int. Cl.[4] ..... C25B 11/04

[52] U.S. Cl. ..... 204/291; 204/293; 252/518; 252/519; 428/568; 75/234; 75/246; 75/247; 148/132; 148/14; 148/134; 148/414; 419/19; 419/38; 419/45; 419/54

[58] Field of Search ..... 75/230, 232, 234, 246, 75/247; 148/13.1, 13.2, 14, 134, 414; 204/64 R, 291, 292, 293, 243 R, 243 M; 252/512, 513, 518, 519, 521; 428/567, 568, 414; 419/19, 32, 38–39, 44, 46, 54, 57

[56] References Cited

U.S. PATENT DOCUMENTS

| | | | |
|---|---|---|---|
| 4,039,417 | 8/1977 | Sasaki et al. | 204/196 |
| 4,057,480 | 11/1977 | Alder | 204/290 R |
| 4,073,647 | 2/1978 | Morgan | 75/235 |
| 4,169,028 | 9/1979 | Yokoyama et al. | 204/147 |
| 4,288,302 | 9/1981 | de Nora et al. | 204/105 R |
| 4,374,050 | 2/1983 | Ray | 252/519 |
| 4,374,761 | 2/1983 | Ray | 252/519 |
| 4,397,729 | 8/1983 | Duruz et al. | 204/243 R |
| 4,399,008 | 8/1983 | Ray | 204/67 |
| 4,423,122 | 12/1983 | Iacovangelo et al. | 429/45 |
| 4,430,189 | 2/1984 | Clark et al. | 204/290 R |
| 4,454,015 | 6/1984 | Ray et al. | 204/293 |
| 4,455,211 | 6/1984 | Ray et al. | 204/293 |
| 4,462,889 | 7/1984 | Landon et al. | 204/292 |
| 4,478,693 | 10/1984 | Ray | 204/64 R |
| 4,484,997 | 11/1984 | Secrist et al. | 204/243 R |
| 4,529,494 | 7/1985 | Joo' et al. | 204/290 R |
| 4,541,912 | 9/1985 | Secrist et al. | 204/290 R |
| 4,544,457 | 10/1985 | Sane et al. | 204/67 |
| 4,552,630 | 11/1985 | Ray et al. | 204/67 |
| 4,560,448 | 12/1985 | Sane et al. | 204/67 |
| 4,600,481 | 7/1986 | Sane et al. | 204/67 |
| 4,614,569 | 9/1986 | Duruz et al. | 204/67 |
| 4,620,905 | 11/1986 | Tarcy et al. | 204/64 R |
| 4,678,760 | 7/1987 | Ray | 501/96 |
| 4,680,094 | 7/1987 | Duruz | 204/67 |

FOREIGN PATENT DOCUMENTS

| | | | |
|---|---|---|---|
| 55-47389 | 4/1980 | Japan | 204/291 |

*Primary Examiner*—John F. Niebling
*Assistant Examiner*—Kathryn Gorgos
*Attorney, Agent, or Firm*—Wells, St. John & Roberts

[57] ABSTRACT

Cermet electrode compositions comprising NiO-$NiFe_2O_4$-Cu-Ni, and methods for making, are disclosed. Addition of nickel metal prior to formation and densification of a base mixture into the cermet allows for an increase in the total amount of copper and nickel that can be contained in the NiO-$NiFe_2O_4$ oxide system. Nickel is present in a base mixture weight concentration of from 0.1% to 10%. Copper is present in the alloy phase in a weight concentration of from 10% to 30% of the densified composition. Such cermet electrodes can be formed to have electrical conductivities well in excess of 100 $ohm^{-1}\ cm^{-1}$. Other alloy and oxide system cermets having high content metal phases are also expected to be manufacturable in accordance with the invention.

9 Claims, No Drawings

CERMET ANODE COMPOSITIONS WITH HIGH CONTENT ALLOY PHASE

This invention was made with government support under Contract No. DE-AC06-76RLO 1830 awarded by the U.S. Department of Energy. The government has certain rights in the invention.

TECHNICAL FIELD

This invention relates to cermet electrodes for use in the electrolytic reduction of a metal from a metal compound dissolved in a molten salt. The invention has specific application in the production of anodes and the electrolytic process for manufacture of aluminum in Hall-Heroult cells.

Electrolytic cells, such as a Hall-Heroult cell for aluminum production by the electrolysis of alumina in molten cryolite, conventionally employ conductive carbon electrodes. The Hall-Heroult process reduces aluminum metal from alumina in a molten salt electrolyte and consumes carbon from a carbon anode in the process. The anode liberates oxygen from the alumina, which results in aluminum metal being collected on the cathode. The oxygen combines with carbon to produce CO and $CO_2$. The overall reaction in its simplest form is represented as follows:

$$2Al_2O_3 + 3C \xrightarrow[Na_3AlF_6]{940°-1000° C.} 4Al + 3CO_2$$

Approximately 0.33 pounds of carbon are consumed for every pound of aluminum produced. The life of carbon anodes is typically two to three weeks.

Carbon obtained from petroleum coke is typically used for fabrication of such anodes. Such material is becoming increasingly expensive. The petroleum coke also typically contains significant quantities of impurities such as sulfur, silicon, vanadium, titanium, iron and nickel. Such impurities can contaminate the metal being produced as well as cause environmental problems and poor working conditions. Removal of excess quantities of such impurities requires extra and costly steps when high purity aluminum is to be produced.

If no carbon were consumed in the reduction of alumina, the overall reaction would be: $2Al_2O_3 \rightarrow 4Al + 3O_2$. Accordingly, non-consumable anodes could be used in a process where carbon does not enter into the electrolytic reaction. Such anodes would have a life limited only by corrosion due to the cryolite electrolyte and electrochemical degradation mechanisms. It is anticipated that the life of such anodes could be extended to several months or even a year or more as compared to the two to three week life of a carbon anode which is consumed in the electrolytic reduction reaction. Furthermore, non-consumable anodes would presumably not add the same significant quantities of impurities as do carbon anodes.

Numerous attempts have been made to develop a non-consumable or inert electrode, but apparently without the required degree of success to make it commercially feasible. The entire aluminum industry still uses consumable carbon anodes in the production of aluminum. Many of the newly developed inert electrodes apparently are reactive or corroded by the electrolyte to an extent which results in contamination of the metal being produced as well as consumption of the anode due to corrosion.

There have been numerous suggestions for non-consumable anode compositions based on various ceramic oxides and oxy compounds. Such materials typically behave as a semi-conductor having inherently low electrical conductivities on the order of 1 ohm $^{-1}cm^{-1}$. (All electrical conductivities referred to in this document relate to conductivity at normal cell operating temperatures of 900° C. to 1,000° C.). Attempts have been made to fabricate non-consumable electrodes with special compositions known as cermets. A cermet composition includes both metallic and ceramic phases. Cermets typically have higher electrical conductivity than pure ceramic compositions, and improved corrosion resistance as compared to metals. The conventional method of preparing cermet compositions is to mix metal and ceramic powders, cold press a preform, and sinter the preform at an elevated temperature in a controlled atmosphere. Alternatively, the cermet can be prepared by hot pressing or hot isostatic pressing wherein the sintering operation is carried out under pressure. Other densification methods for forming oxides and metals into cermets may also be usable.

One promising oxide system identified for use with cermets is the $NiO\text{-}NiFe_2O_4$ system. However, most cermets using this oxide system, or other oxide systems, still have low electrical conductivities, on the order of 1 to 10 ohm$^{-1}$cm$^{-1}$. Prior art oxide systems containing nickel in the metal phase (a $NiO\text{-}NiFe_2O_4$-Ni cermet) have been fabricated by reaction sintering processes and exhibit excellent electrical conductivity on the order of 300 ohm$^{-1}$cm$^{-1}$. This is even an improvement over the conductivity of carbon anodes which typically average approximately 200 ohm·1cm·1. However, typical cermets are susceptible to anodic dissolution by corrosion. This causes anodes of such material to fail prematurely and also contaminate the produced aluminum with nickel.

Copper has also been incorporated into the $NiO\text{-}NiFe_2O_4$ matrix creating an $NiO\text{-}NiFe_2O_4$-Cu cermet. The Cu metal phase is discontinuously distributed within the oxide matrix, but still provides improved electrical conductivity on the order of 60 to 70 ohm$^{-1}$cm$^{-1}$. Such a material had a copper content of 17 weight percent.

For example, U.S. Pat. No. 4,620,905 to Tarcy et al. discloses an $NiO\text{-}NiFe_4O_4$-Cu-Ni cermet wherein 17% of the composition is comprised of a metal alloy of copper and nickel. The nickel metal is understood to arise primarily from the reduction of excess NiO in the oxide phase induced by the presence of carbon-based binders used to produce the oxide powders (col. 5, lines 3–14).

U.S. Pat. Nos. 4,374,761; 4,478,693; 4,399,008; and 4,374,050 to Ray and 4,455,211 to Ray et al. also disclose non-consumable cermet electrodes for use in molten salt electrolysis. The electrodes disclosed are stated to be comprised of ceramic oxide compositions having at least one metal powder disbursed therethrough for purposes of increasing electrical conductivity. The metal powder is stated to be selected from the group consisting of Co, Fe, Ni, Cu, Pt, Rh, In, and Ir or alloys thereof. The metal is also stated to be provided in the electrode composition in amounts not constituting more than 30 volume percent metal. Additionally, elemental copper is stated to be includable in an amount up to 30 weight percent of the finished composition using the Ray processes. However, no example in any of these patents supports the broad statements concerning achieving high metal content in a cermet. Further, the metal is indicated as being coated with a wax binder to prevent the metal particles from oxidizing during the sintering step. Additionally, the electrical conductivities of the example electrodes range from 0.4 $ohm^{-1}cm^{-1}$ to 32 $ohm^{-1}cm^{-1}$.

Prior to the present invention, 17% metal alloy of copper and nickel was understood to be at or close to the practical upper limit of including an alloy of copper and nickel or pure copper within a $NiO-NiFe_2O_4$ oxide system, despite statements in the above prior art patents. Apparently in these processes, additions of copper above this limit merely bled out of the composite during sintering, forming small copper metal beads on the surface of the cermet.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

We have discovered that if powder preparation procedures are carefully controlled, and using micron or sub-micron copper particles in high-energy milling techniques, loading of the metal phase could be increased to 20 wt% and above. This higher loading of alloy is apparently maintained due to solid state diffusion during controlled sintering. Minimum bleed-out of copper occurs. In prior art techniques, the amount of copper metal bleed-out related directly to metal powder loading above approximately 17%. Our higher alloy loading was possible due to a carefully controlled process including milling techniques, small copper particles, and controlled sintering.

Addition of nickel metal to a base mixture containing copper prior to densification of the base composition into a cermet has been discovered to enable an increase in the total amount of metal which can be contained in the cermet. Addition of nickel metal enables creation of a copper-nickel metal alloy which does not bleed from the cermet during sintering. Alternately, a copper-nickel alloy could be provided in a base mixture during powder preparation prior to densification into a cermet.

In accordance with the invention, total weight concentration of the copper-nickel alloy phase within the cermet can be included in at least 20 weight percent of the densified compositions to provide electrical conductivities in excess of 100 $ohm^{-1}cm^{-1}$. Copper is included in the copper-nickel alloy phase in a weight concentration which is greater than the content of nickel. Preferably, the weight concentration of copper itself is in excess of 20% of the densified composition to achieve high conductivity.

The preferred process for making electrodes in accordance with the invention includes sintering of compacted or formed shapes of the base mixture. Densification methods other than sintering would also be usable without departing from the principles and scope of the invention. Regardless of the densification method, nickel should be present in the base mixture in a weight concentration ranging from 0.1% to 10% to achieve an increase in total amount of retained metal within the oxide system. The preferred concentration range is a base mixture weight concentration of nickel from 2.0% to 4.0%. Concentration ranges for copper in the base mixture and final alloy phase should be from 10 weight percent to 30 weight percent, with 20 weight percent to 30 weight percent being preferred. Both of these metal powders are preferred with an average particle size of 2 to 3 microns.

More particularly, the preferred process for making an electrode in accordance with the invention comprises combining $NiO-NiFe_2O_4$ powder with copper powder and nickel powder to produce a base mixture. NiO and $NiFe_2O_4$ can be combined as powders. Other oxide powder combinations can be used to produce a desired spinel nickel oxide matrix. A combination of oxide powders that produces a $NiO-NiFe_2O_4$ oxide phase in the finished product is most preferred. The $NiO-NiFe_2O_4$ oxide used in this process was a fully reacted, calcined, and spray-dried powder with agglomerates of approximately 50 microns. This was used due to availability, and is of little importance since these agglomerates where broken down to micron size particles during milling. However, small and high surface area particles with a binder provided during spray-drying are considered important in achieving optimum results. The oxide powder combination could also be prepared during milling along with addition of the metals or metal alloy powders, then spray dried to provide the agglomerates to improve powder flowability or packing. The preferred concentration of nickel and copper, as described above, should be from 2.0% to 4.0% and 20% to 30%, respectively. The remainder of the base mixture should consist essentially of the oxide powders. Where the added powders are NiO and $NiFe_2O_4$, the preferred weight ratio of NiO to $NiFe_2O_4$ is from 2:3 to 3:2.

The base powder mixture is blended using simple shaker-mixing techniques, or more preferably is vibrationally milled. Simple blending procedures are typically performed dry. Vibration milling is used to produce cermets having a more uniform homogenous distribution of the metal phase than possible by using simpler shaker-mixing techniques. For vibration milling, stainless steel mixing balls are added to a mixing bottle containing the base powder mixture. A liquid Freon (TM) based solution can be used as the milling solution, or the mixture can be milled dry. The Freon (TM) functions as a lubricant which volatilizes away after completion of the milling. The base mixture-solution is preferably vibratory milled from 0.5 to 24 hours and allowed to dry.

The milled base powder mixture is then formed into desired green-body shapes using conventional pressing techniques. The final pressure of the formed mixture will preferably be approximately 25 Kpsi which provides sufficient strength for handling and machining of such green-bodies. The formed green-bodies are next placed into a sintering furnace having controlled atmosphere capabilities. The furnace preferably has alumina walls as opposed to metal walls which have been shown to cause excessive reduction of the nickel and iron from the oxides. The furnace atmosphere is preferably relatively inert containing either argon or nitrogen. Oxygen is necessary in the range of 100 ppm to 500 ppm, but preferably not higher than 250 ppm to obtain optimum results. The furnace is also preferably ramped to a hold temperature just below the melting point of copper, and held for a period of time up to 50% of the sintering time. The heating rate and hold period allow the alloy to stabilize which contributes to the reduction of metal phase bleedout. This heating cycle is increased to sintering temperatures up to 1300° C. for a holding period of up to 8 hours. This hold time at temperature, as well as heating and cooling down rates, is dependent upon the physical size and mass of the anode being produced.

When elemental copper and elemental nickel are included in the base mixture, a copper-nickel alloy forms. The produced alloy has a melting point which is higher than the temperature at which solid state sintering occurs thus preventing metal phase bleed out from the sintering body. This results in a $NiO-NiFe_2O_4$-Cu-Ni cermet which has a higher alloy content than possible by using only copper metal additions.

As described in the background, prior art $NiO-NiFe_2O_4$-Cu-Ni cermets have been developed, but exhibit less than desirable electrical conductivities and have an upper copper content of 17 weight percent of the finished composition. Prior art examples of such cermets contain a small portion of nickel in the metal phase due primarily to the reduction of excess NiO in the oxide phases induced by the presence of carbon-based binders used to produce the oxide powders. However, the sintering temperature for producing the cermet is apparently reached before sufficient NiO has been reduced to elemental Ni which would be available for alloying with copper. Accordingly, the copper content of cermets manufactured by prior art processing methods has been determined to be upwardly limited to approximately 17 weight percent above which point appreciable copper bleedout occurs.

Applicant's discovery enables nickel metal to be available for alloying immediately at temperatures at or lower than the temperature at which elemental nickel reduces from NiO, which is the primary source for nickel where nickel metal is not added to the base mixture composition. In short, there is no requirement for a reduction to take place prior to alloying of nickel with copper when elemental nickel is included in the base mixture. The resulting alloy has a melting temperature which is higher than the sintering temperature which enables a greater content of the alloy phase to be included. This increases electrical conductivity. The invention could also be practiced by providing a nickel-copper alloy in the base mixture.

Reduction of excess NiO apparently also occurs to an appreciable extent in the inventive process. For example, cermets produced using 21 base mixture weight percent copper and 4 base mixture weight percent nickel (approximately 84 percent copper and 16 percent nickel in the metal portion), have a sintered composition of approximately 60 weight percent copper and 40 weight percent nickel in the finished metal phase. Accordingly, nickel is apparently being added to the alloy by reduction from excess NiO.

Although this disclosure refers primarily to $NiO-NiFe_2O_4$ oxide systems with a Cu-Ni alloy phase, other oxide and metal systems would be usable by skilled artisans without departing from the principles and scope of the invention. In such alternate system, the alloy phase would be comprised of at least two metals which have defined melting points when pure. An alloy of the two metals would be formed before or during sintering which would have a melting point greater than the lower of the pure melting points of the two metals. This would enable a greater concentration of the alloy phase by preventing the lower melting point metal from melting prior to sintering. Such would enable the produced cermet to have a combined weight concentration of an alloyed metal phase of at least 20 percent to significantly enhance electrical conductivity.

EXAMPLE 1

A cermet formed from 3 weight percent elemental nickel powder, 22 weight percent elemental copper powder and 75 weight percent $NiO-NiFe_2O_4$ powder was prepared by the technique described above. The molar ratio of NiO to $NiFe_2O_4$ was approximately 1.2 at the sintering temperature. The base mixture was vibratory milled for 2.5 hours using a Freon (TM) based solution. After milling, the solution was removed from the mixing apparatus and dried. The powder was pressed into a shape to a final pressure of 25 Kpsi. Sintering was performed in a furnace with an atmosphere comprising essentially gaseous argon, with oxygen ranging from 150 to 200 ppm. The sample was slowly heated over a 16 hr period to a diffusion soak temperature below the melting point of copper, (preferably about 1075° C.) and held at such temperature for 2 hrs. The sample was then further heated at a rate of approximately 100° C. per hr to a temperature of 1300° C., and held at such temperature for approximately 8 hours. The sample was furnace cooled at a rate of approximately 100° C per hour. Analysis of the sample determined that the alloy phase was discontinuous with the electrical conductivity of the sintered body being 170 $ohm^{-1}cm^{-1}$.

EXAMPLE 2

Two separate samples were produced using 21 weight percent elemental copper powder, 4 weight percent elemental nickel powder, and 75 weight percent $NiO-NiFe_2O_4$ powder. The molar ratio of NiO to $NiFe_2O_4$ powder was approximately 1.1 to 1.2 at the sinter temperatures. Both samples were prepared by simple shaker-mixer powder blending and were compacted into sample shapes to a final pressure of 25 Kpsi. The two samples were heated at the same rate to the diffusion soak temperature as in Example 1, and then heated to sintering temperatures of 1150° C. and 1200° C. respectively. The furnace atmosphere comprised essentially gaseous argon, with oxygen ranging from 150 to 200 ppm. Each sample was maintained at the respective sintering temperature for a holding period of 8 hours. Cool down rate of both samples was 100° C. per hour.

Examination of both samples indicated that the copper-nickel alloy phase was discontinuous throughout the sample. Electrical conductivity of the sample sintered at 1150° C. was 169 $ohm^{-1}cm^{-1}$. The electrical conductivity of the sample sintered at 1200° C. was 172 $ohm^{-1}cm^{-1}$.

In compliance with the statute, the invention has been described in language more or less specific as to structural and methodical features. It is to be understood, however, that the invention is not limited to the specific features described, since the methods herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A process for producing a cermet electrode having an oxide phase and a metal phase for use in the electrolytic reduction of a metal from a metal compound dissolved in a molten salt, the process comprising the following steps:

combining an oxide containing powder comprising nickel/iron/oxide and NiO with a metal containing powder comprising Ni-Cu to produce a base mixture, the metal containing powder comprising at least Cu and Ni each having a defined melting point when pure, with the Cu melting point being less than a temperature at which the base mixture sinters into a cermet, the Cu and Ni metals having a combined weight concentration of at least 20%;

forming the base mixture into a desired shape;

densifying the formed base mixture by heating to a sintering temperature to:

(a) alloy the Cu and Ni to produce an alloy comprising at least Cu and Ni and which has a melting point which is greater than the pure Cu metal melting point, the alloy melting point being greater than the sintering temperature at which the oxide and alloy comprising at least Cu, Ni form a densified cermet; and (b) produce a cermet electrode composition having an oxide phase comprising NiO-nickel/iron/oxide and an alloy phase comprising at least Cu and Ni, the weight concentration of the alloy phase being at least 20% of the cermet electrode composition;

wherein the step of densifying by heating the base mixture comprises:

raising the temperature of the formed base mixture to a value just below the melting point of Cu, and holding the formed based mixture at such a value to allow the metal alloy to form and stabilize; and then, raising the temperature of the formed base mixture further to a sintering temperature.

2. A cermet electrode produced by the process of claim 1.

3. A cermet electrode produced by the process according to claim 1, and wherein:

copper in the alloy phase is present in a weight concentration in excess of 20% of the densified composition.

4. A cermet electrode produced by the process according to claim 1, and wherein:

nickel is present in a base mixture weight concentration of from 0.1% to 10%.

5. A cermet electrode produced by the process according to claim 1, and wherein:

nickel is present in a base mixture weight concentration of from 2.0% to 4.0%.

6. A cermet electrode produced by the process according to claim 1, and wherein:

nickel is present in a base mixture weight concentration of from 0.1% to 10% and copper in the alloy phase is present in a weight concentration of from 10% to 30% of the densified composition.

7. A cermet electrode produced by the process according to claim 1, and wherein:

nickel is present in a base mixture weight concentration of from 2.0% to 4.0%; and copper in the alloy phase is present in a weight concentration of from 20% to 30% of the densified composition.

8. A cermet electrode produced by the process according to claim 1, and wherein:

the base mixture concentrations of nickel and copper are approximately three weight per cent nickel and twenty-two weight per cent copper, the densified electrode having an electrical conductivity of at least approximately 170 $ohm^{-1}$ $cm^{-1}$ at between 900° C. and 1000° C.

9. An electrolytic cell for producing metal by a reduction process in which oxygen is liberated, the cell comprising:

a molten salt electrolyte comprising an oxide of a metal to be collected;

a cathode for collecting the metal to be collected; and a cermet anode electrode produced by the process according to claim 1.

* * * * *